US010717954B2

(12) United States Patent
Astete Boettcher

(10) Patent No.: US 10,717,954 B2
(45) Date of Patent: Jul. 21, 2020

(54) DETERGENT COMPOSITION IN THE FORM OF A SHEET

(71) Applicant: SOLUBAG SpA, Santiago (CL)

(72) Inventor: Roberto Astete Boettcher, Concepcion (CL)

(73) Assignee: SOLUBAG SpA, Santiago (CL)

( * ) Notice: Subject to any disclaimer, the term of this patent is extended or adjusted under 35 U.S.C. 154(b) by 0 days.

(21) Appl. No.: 16/330,732

(22) PCT Filed: Sep. 5, 2017

(86) PCT No.: PCT/CL2017/000028
§ 371 (c)(1),
(2) Date: Mar. 5, 2019

(87) PCT Pub. No.: WO2018/045478
PCT Pub. Date: Mar. 15, 2018

(65) Prior Publication Data

US 2019/0194584 A1 Jun. 27, 2019

(30) Foreign Application Priority Data

Sep. 6, 2016 (CL) ..... 2241-2016

(51) Int. Cl.

| | |
|---|---|
| ***C11D 1/12*** | (2006.01) |
| ***C11D 1/72*** | (2006.01) |
| ***C11D 1/83*** | (2006.01) |
| ***C11D 3/18*** | (2006.01) |
| ***C11D 3/32*** | (2006.01) |
| ***C11D 3/50*** | (2006.01) |
| ***C11D 17/06*** | (2006.01) |
| ***C11D 1/00*** | (2006.01) |
| ***C11D 3/00*** | (2006.01) |
| ***C11D 3/20*** | (2006.01) |
| ***C11D 3/37*** | (2006.01) |
| ***C11D 11/00*** | (2006.01) |
| *C11D 1/14* | (2006.01) |

(52) U.S. Cl.
CPC ..... *C11D 17/06* (2013.01); *C11D 1/00* (2013.01); *C11D 1/83* (2013.01); *C11D 3/00* (2013.01); *C11D 3/18* (2013.01); *C11D 3/2065* (2013.01); *C11D 3/32* (2013.01); *C11D 3/3753* (2013.01); *C11D 3/50* (2013.01); *C11D 11/0017* (2013.01); *C11D 1/146* (2013.01); *C11D 1/72* (2013.01)

(58) Field of Classification Search
CPC .. C11D 1/12; C11D 1/146; C11D 1/72; C11D 1/83; C11D 3/18; C11D 3/2065; C11D 3/32; C11D 3/3753; C11D 3/50; C11D 17/06
See application file for complete search history.

(56) References Cited

U.S. PATENT DOCUMENTS

| | | | | |
|---|---|---|---|---|
| 6,818,606 | B1 | 11/2004 | Hanada et al. | |
| 7,094,744 | B1 | 8/2006 | Kobayashi et al. | |
| 2008/0242572 | A1 | 10/2008 | Icht et al. | |
| 2015/0218497 | A1* | 8/2015 | Jalbert ..... | C11D 11/00 510/298 |
| 2016/0102279 | A1 | 4/2016 | Labeque et al. | |

FOREIGN PATENT DOCUMENTS

| | | | |
|---|---|---|---|
| CA | 2695068 | A1 | 9/2010 |
| CA | 2842442 | A1 | 8/2015 |
| WO | WO 2016/061069 | A2 | 4/2016 |

OTHER PUBLICATIONS

Farn, R.J.,Chemistry and Technology of Surfactants, Technology of Surfactants, 2006, Blackwell Publishing Ltd, Oxford, United Kingdom, (331 Pages Total): ISBN-13:978-14051-2696-0; ISBN-10:1-4051-2696-5.

International Search Report and Written Opinion, issued by International Searching Authority in corresponding International Application No. PCT/CL2017/000028, dated Jan. 2, 2018.

* cited by examiner

*Primary Examiner* — Brian P Mruk
(74) *Attorney, Agent, or Firm* — Arent Fox LLP

(57) ABSTRACT

The present invention describes a detergent composition in the form of a flexible sheet, which in turn is soluble in water, and the water-soluble detergent sheet. Said detergent composition in the form of a flexible sheet comprises a unique mixture of components, including: a water-soluble polymeric component, an anionic surfactant, a non-ionic surfactant, water and other components. Once mixed in the appropriate proportions, the components produce a flexible sheet with detergent characteristics that can be incorporated directly into a clothes-washing recipient, said recipient ranging from a simple bowl to an advanced automatic washing machine. Once the detergent sheet comes into contact with water inside the washing recipient, the sheet dissolves and releases the active ingredients and complementary ingredients contained therein.

11 Claims, No Drawings

DETERGENT COMPOSITION IN THE FORM OF A SHEET

CROSS-REFERENCE TO RELATED APPLICATIONS

This application is a National Stage Entry of International Patent Application PCT/CL2017/000028, filed Sep. 5, 2017, which claims priority to Chilean Patent Application No. 2241-2016, filed Sep. 6, 2016. The entire contents of each of the priority applications are incorporated herein by reference.

The present invention describes a detergent composition in the form of a flexible sheet, which in turn is soluble in water, and the water-soluble detergent sheet. Said detergent composition in the form of a flexible sheet comprises a unique mixture of components, including: a water-soluble polymeric component, an anionic surfactant, a non-ionic surfactant, water and other components. Once mixed in the appropriate proportions, the components produce a flexible sheet with detergent characteristics that can be incorporated directly into a clothes-washing recipient, said recipient ranging from a simple bowl to an advanced automatic washing machine. Once the detergent sheet comes into contact with water inside the washing recipient, the sheet dissolves and releases the active ingredients and complementary ingredients contained therein.

DESCRIPTION OF THE PRIOR ART

Nowadays, most laundry detergents typically come as liquid or powder. Frequently, powder detergents do not fully dissolve in the washing recipient, and many times, due to their lack of fluidity, residues stay in the recipient inside a washing machine, forming little scabs that adhere to the recipient walls; other times, their lack of solubility leaves residues in the laundry items, causing the need for a second washing cycle. The liquid detergent, although improves the fluidity and prevents formation of residues, can be a little impractical in case of spills, and can be hard to clean. Consumers demands for laundry products that clean their clothes without damaging them are higher every day, demanding also an appealing appearance and, especially, that the product can be handled easily and comfortably.

The prior art registers some attempts at this, by different inventors who have tried to find a solution to the problem of liquid or powder detergents by means of using a sheet. Invention U.S. Pat. No. 4,938,888 describes a combination of a detergent-permeated flexible substrate. The substrate consists of paper or woven fabric; however, one disadvantage of that is that the substrate remains inside the washing machine after the washing cycle is complete, due to its inability to dissolve. Invention U.S. Pat. No. 4,853,142 describes a plastic band containing detergent; but once again, this has the same disadvantage as the paper or fabric mentioned above, that is, the fabric remains in the washing machine after the washing cycle is complete. One more attempt at providing a detergent sheet product is described in invention U.S. Pat. No. 6,818,606, wherein a layer of a detergent mix is located between two layers of a water-soluble substrate, wherein said substrate consists of mainly a water-soluble inorganic substance. On the other hand, invention U.S. Pat. No. 7,094,744 discloses a detergent sheet consisting of a first layer of a nonwoven water-soluble material with a base weight of 20 g/m2, and a second layer of a water-soluble film, the laminated product being later located on the nonwoven water-soluble fabric, which acts as a second outer layer. The main disadvantage of this product is the complexity of the method required for its production, and the introduction of elements within the soluble substrate, which do not take part in, nor add value to, the cleaning of the clothes inside the washing machine.

Therefore, there is a need for a detergent in the form of a sheet, that is easily handled and can to be stored in a dry state and, most importantly, that dissolves completely during the washing cycle, leaving no residues. It is desirable that this product is really effective in the washing cycle and that it does not damage the clothes being washed.

SUMMARY OF THE INVENTION

The invention described herein corresponds to a detergent composition, in the form of a flexible sheet, which is also water-soluble, and consists of a mixture of detergent elements, conditioners and water.

Particularly, the present invention describes a detergent composition in the form of a flexible sheet, which in turn is soluble in water, consisting of:

(i) 10-15% (p/p) of a water-soluble polymeric component;
(ii) 30-37% (p/p) of an anionic surfactant;
(iii) 7-10% (p/p) of a non-ionic surfactant;
(iv) 1-4% (p/p) of a mineral oil;
(v) 11-17% (p/p) of glycerin;
(vi) 1-4% (p/p) of coconut diethanolamide;
(vii) 18-25% (p/p) of water; and
(viii) 0.5-2.0% (p/p) of at least one additional supplementary component.

Once mixed in the appropriate proportions, the components produce a liquid that is poured on a drying plate, and after the evaporation of the excess water, results in a sheet that remains solid and flexible but, when used, is completely water-soluble. This sheet can be used in a clothes washing machine and it will release its components when water is added and it is stirred.

In a preferred embodiment, the detergent composition in the form of a flexible, water-soluble sheet in the present invention consists of:

(i) 10-15% (p/p) of polyvinyl alcohol;
(ii) 30-37% (p/p) of sodium dodecyl sulfate;
(iii) 7-10% (p/p) of primary alcohol ethoxylate;
(iv) 1-4% (p/p) of a mineral oil;
(v) 11-17% (p/p) of glycerin;
(vi) 1-4% (p/p) of coconut diethanolamide;
(vii) 18-25% (p/p) of water; and
(viii) 0.5-2.0% (p/p) of perfume.

In other embodiments of the invention, the same detergent composition can include fragrances, colorants, and whitening agents.

DETAILED DESCRIPTION OF THE INVENTION

The present invention refers to a detergent composition in the form of a flexible sheet, which in turn is soluble in water, consisting of the following components:

(i) 10-15% (p/p) of a water-soluble polymeric component;
(ii) 30-37% (p/p) of an anionic surfactant;
(iii) 7-10% (p/p) of a non-ionic surfactant;
(iv) 1-4% (p/p) of a mineral oil;
(v) 11-17% (p/p) of glycerin;
(vi) 1-4% (p/p) of coconut diethanolamide;
(vii) 18-25% (p/p) of water; and
(viii) 0.5-2.0% (p/p) of at least one additional supplementary component.

Since the present invention discloses a detergent composition, the main component thereof will evidently be the surfactant agent, also known as tensoactive agent. For the present case, both "surfactant" and "tensoactive" refer to the same object, although technically they might slightly differ from one another. Therefore, within the present invention, both terms "surfactant" and "tensoactive" will be used indistinctly and will refer to the same object.

Surfactant or tensoactive means such substance consisting of amphiphilic molecules and possessing a superficial or interfacial activity, being able to reduce the superficial tension between two phases (liquid-liquid or solid-liquid). The amphiphilic molecules included in the surfactant could have a moistening action and a solubilizing power, which, when combined, generate a cleaning action that will define the surfactant in general.

In a wider definition, the surfactant material can consist of, in general, one or more surfactants, which can be selected from anion, cationic, non-ionic, hybrid or amphoteric species, and mixtures thereof (provided that they are compatible with each other). For example, they can be selected from any of the classes, subclasses and specific materials described in "Surface Active Agents", by Schwartz & Perry, vol I, Interscience, 1949; in "Surface Active Agents", by Schwartz, Perry & Berth, vol. II (Interscience, 1958); in the current edition of "Emulsifiers & Detergents", by McCutcheon, published by the McCutcheon Division of the Manufacturing Confectioners Company; or in "Tensid-Taschenbuch", by H. Stache, 2nd edition, Carl Hauser Verlag, Munich & Viena, 1981.

The detergent composition in the form of a flexible sheet in the present invention can contain synthetic anionic surfactant ingredients, preferably in combination with non-ionic surfactant materials. The appropriate anionic surfactants are usually water-soluble salts from alkali metal sulfates and organic sulfonates having alkyl radicals containing from approx. 8 to approx. 22 carbon atoms, the term alkyl including the alkyl portion of higher acyl radicals. Examples of appropriate synthetic anionic surfactant compounds are: sodium and potassium alkyl sulfates, especially those obtained by sulfating higher alcohols (C8-C18), for example, from fat or coconut oil; (alkyl C9-C20) sodium and potassium benzene sulfonates, especially (linear secondary alkyl C10-C15)sodium benzene sulfonates; alkyl-glycerylether sodium sulfates, especially higher alcohol derived from fat or from coconut oil, and synthetic alcohols derived from petroleum, sodium sulfates and sulfonates from coconut oil fatty monoglycerides; sodium and potassium salts from sulfuric acid esters from products of the reaction between fatty alcohol C8-C18 and alkylene oxide, particularly ethylene oxide; the products of the reaction between fatty acids, such as coconut fatty acids esterified with isethionic acid and neutralized with sodium hydroxide, sodium and potassium salts from methyltaurine fatty acids amines; alkane monosulfonates, such as the ones obtained from the reaction between alpha-olefins C8-C20 and sodium bisulfite, and the ones obtained from the reaction between paraffin and SO2 and Cl2 and later hydrolyzing with a base for producing a random sulfonate; and olefin sulfonates, a term used to describe the material made from reacting olefins, particularly alpha-olefins C10-C20, with SO3 and later neutralizing and hydrolyzing the product of the reaction. The preferred anionic surfactant compounds in this invention are (alkyl C11-C15)sodium benzene sulfonates and (alkyl C18-C18)sodium sulfonates. Particularly, in this invention, the preferred main surfactant material is an anionic surfactant of the alkyl sulfate type, preferably, the anionic surfactant is dodecyl sodium sulfate.

A non-ionic surfactant is also included in the present invention. This type of surfactant does not produce ions in an aqueous solution and, therefore, is compatible with the other types of surfactants and can be integrated in complex formulations. Non-ionic surfactants have the distinctive feature that in an aqueous solution, they do not ionize, since they possess hydrophilic groups of the alcohol, phenol, ether or amide type. A large proportion of said surfactants can turn relatively hydrophilic thanks to the presence of a polyether chain of the ethylene polyoxide type. The hydrophobic group is generally an alkyl radical or alkyl benzene, and sometimes a naturally originated structure such as a fatty acid, especially when a low toxicity is required.

Non-ionic surfactants are generally good moistening and emulsifying detergents. Some of them possess excellent foaming properties. Given all of the above-mentioned properties, non-ionic surfactants are currently found in all types of liquid or powder detergent formulations, as well as in other applications. There are different types or non-ionic surfactants, but the market is dominated by the byproducts containing an ethylene polyoxide chain fixed on a hydroxyl or amine group. Commonly known non-ionic surfactants are ethoxylated linear alcohols, ethoxylated alkyl phenols, fatty acid esters, amine- and amide-byproducts, ethylene-oxide copolymers, propylene oxide and ethoxylated polyalcohols. The preferred non-ionic surfactants in the present invention are ethoxylated linear alcohols. Particularly, in the present invention, the preferred anionic surfactant material is a primary alcohol ethoxylate.

The invention described herein corresponds to a flexible detergent sheet, made of a mixture of tensoactive elements and other supplementary components. Said detergent sheet, when dry, has the consistency of a material that remains solid and flexible, but having the characteristic that it is completely soluble in water. In order to achieve said characteristic, a polymeric component is required, having the ability of forming a film and being dissolved in water. A polymer is soluble in water when it possesses a sufficient number of hydrophilic groups along its main chain or side chains, said groups consisting primarily of amines, amides, carboxyl groups and sulfonic groups. There are natural and synthetic water-soluble polymers; the former include carboxymethyl cellulose, starch and xanthan gum; the latter include polyacrylamides, polyethylenes, chloride polyvinyl and alcohol polyvinyl. The preferred polymeric material in the present invention is alcohol polyvinyl. Said polyvinyl alcohol (PVOH) is a water-soluble synthetic polymer, with the general chemical formula $(C_2H_4O)_n$.

Polyvinyl alcohol has excellent properties as a film former, an emulsifier and an adhesive. It is also resistant to oil, fat and solvents. An important characteristic is that it is odorless and non-toxic. It possesses a high strength and flexibility, and high barrier properties for oxygen and smells. Polyvinyl alcohol is completely biodegradable and quickly dissolved, with a melting point of 230° C. (446° F.) and 180-190° C. (356-374° F.) for the totally hydrolyzed and partially hydrolyzed versions, respectively. Polyvinyl alcohol does not melt as a thermoplastic, but degrades by water loss from two adjacent hydroxyl groups at temperatures above 150° C. (302° F.). Polyvinyl alcohol is water-soluble; it dissolves slowly in cold water, but quicker at high temperatures, and can normally dissolve at above 90° C. (194° F.). Polyvinyl alcohol degrades quickly above 200° C. (392° F.).

Polyvinyl alcohol, to some extent, has characteristics similar to those of cellulose. Due to the secondary alcohol group located on the macromolecular line, polyvinyl alcohol has a good film-formation property; likewise, sodium chloride can be used together with the polyvinyl alcohol in order to achieve, synergically, the thickening of the solution. Moreover, based on the disclosures in the literature, polyvinyl alcohol can prevent the re-sedimentation of dirt when applied to washing products.

Another relevant component in the composition of the detergent in the form of a flexible sheet, which is in turn water-soluble, according to the present invention, is mineral oil, which acts by easily forming an oil film on a substrate, has an moisturizing and conditioning effect; high-quality cosmetic mineral oil can also be used as an anti-static and softening agent. A mineral oil is a liquid byproduct of petroleum, generally clear, colorless and odorless. It is obtained by the distillation of raw petroleum, and from a chemical point of view, it is similar to petroleum jelly. It consists of long-chain hydrocarbons, and there are different types regarding density and viscosity. There is a wide variety of mineral oils available in the market, but for the present invention, a cosmetic-grade mineral oil is preferred.

Glycerin or glycerol is one more component included in the detergent composition in the shape of a flexible sheet described in the present invention. Glycerol or glycerin corresponds to the 1,2,3-propanetriol (C3H8O3) and is, generally described, an alcohol with three hydroxyl groups (–01-1). Its physical appearance is a viscous liquid, colorless but with a characteristic odor, and a sweet flavor. Likewise, glycerol is a hygroscopic compound, which means that it has the ability of transferring or absorbing the moisture present in the environment around it. Moreover, it is easily soluble in water and can be found in the form of a liquid at an ambient temperature of 25 C (77° F.). For the present case, glycerol or glycerin generally plays the role of a water softener, a moisturizer, and a thickener in the detergent composition.

One more component of the detergent composition in the form of a flexible sheet of the present invention is coconut diethanolamide, also known as cocamide. Coconut diethanolamide is a fatty acid obtained from coconuts; given that it is an amide originated from refining or reaction processes of coconut oil, it is of high quality in its molecular proportion of 1:1. Coconut diethanolamide is known by its multiple applications within the industry, especially due to its excellent properties as a foam stabilizer for all kinds of detergents. Coconut diethanolamide can also act as an important type of non-ionic tensoactive agent, having good characteristics such as foam formation, foam stability, filtration and decontamination, and resistance to hard water.

In the detergent composition in the form of a flexible sheet of the present invention, water is one more component thereof; used as a solvent, facilitating the mixture of components, and while the vast majority of water evaporates during the drying process of the sheet, it provides enough moisture so the final sheet product is flexible and not brittle.

Other possible ingredients are also included, which are supplementary to the detergent composition in the form of a flexible sheet, and provide useful results for cleaning and protecting clothing items, or that make the sheet product more appealing to the consumer. Said supplementary ingredients include:

- compounds with bactericide and fungicide properties, such as methylparaben and propylparaben;
- fluorescent brighteners for boosting colors in the fabrics through a "whitening" effect; said brighteners include: Tinopal CBS-X by Ciba® Blancophor G by Tanatex Chemical; both products being colorants that absorb light in the ultra violet and violet region (generally 340-370 nm) of the electromagnetic spectrum, and re-emit light in the blue region (typically 420-470 nm);
- a chelating agent for reducing hardness in water, and thus increasing the effectiveness of detergents, such as ethylenediaminetetraacetic acid (EDTA);
- whitening agents, including calcium hypochlorite, sodium hypochlorite, sodium perborate, sodium persulfate, tetrasodium pyrophosphate and urea peroxide;
- perfumes or fragrances; said perfume or fragrance must be able to cover the smell of the base of the detergent, resist the washing and drying phases, and leave a pleasant smell on the washed pieces of clothing. There is a wide variety of vendors in the market that can supply the right perfume for the detergent composition;
- colorants that are able to absorb certain lengths; colorants are substances that fix to other substances and provide them with color in a stable manner given certain physical or chemical factors, such as light and oxidizing agents. For the present case, if the intention is to give a specific color to the sheet formed by the detergent composition, some colorant must be incorporated based on the desired color.
- fabric softeners can also be included in the detergent composition of the present invention; said softeners are based on cations/quaternary ammonium salts and silicone-based compounds, such as cetrimonium bromide, quaternary ammonium chloride, and polydimethylsiloxane.

Thus, the detergent composition in the form of a flexible, water-soluble sheet, according to the present invention, can be defined based on the following characteristics:

- the water-soluble polymeric component is polyvinyl alcohol;
- the anionic surfactant is of the alkyl sulfate type, specifically, it is dodecyl sodium sulfate;
- the non-ionic surfactant is primary alcohol ethoxylate;
- the additional supplementary component is selected from the group consisting of: whiteners, brighteners, colorants, perfumes, and softeners.

In a preferred embodiment of the present invention, the detergent composition in the form of a flexible, water-soluble sheet, consists of:

(i) 10-15% (p/p) of polyvinyl alcohol;
(ii) 30-37% (p/p) of sodium dodecyl sulfate;
(iii) 7-10% (p/p) of primary alcohol ethoxylate;
(iv) 1-4% (p/p) of a mineral oil;
(v) 11-17% (p/p) of glycerin;
(vi) 1-4% (p/p) of coconut diethanolamide;
(vii) 18-25% (p/p) of water; and
(viii) 0.5-2.0% (p/p) of perfume.

All ingredients of the detergent composition in the form of a flexible, water-soluble sheet, as defined above, once mixed in the appropriate proportions, combine to produce a liquid that can be poured on a large hot drying plate, wherein the liquid is extended on the plate to form a coating of even thickness, which is later dried. The resulting sheet has a thickness between 0.1 mm and 8 mm, and can be cut into portions based on the size of the washing load and according to the desired business strategy. The resulting washing sheet remains solid and flexible, but is soluble in water. This sheet can be used in a clothes washing machine and it will release the detergent and its other components when water is added.

Once the load and the clothes washing cycle are completed, the components of the sheet are eliminated in the residual water.

In a preferred embodiment, the ingredients forming the laundry sheet according to the present invention, are mixed and processed to originate a water-soluble detergent sheet consisting of:

(i) 10-15% (p/p) of polyvinyl alcohol;
(ii) 30-37% (p/p) of sodium dodecyl sulfate;
(iii) 7-10% (p/p) of primary alcohol ethoxylate;
(iv) 1-4% (p/p) of a mineral oil;
(v) 11-17% (p/p) of glycerin;
(vi) 1-4% (p/p) of coconut diethanolamide;
(vii) 18-25% (p/p) of water; and
(viii) 0.5-2.0% (p/p) of perfume.

The water-soluble detergent sheet, according to the present invention, can have a polygonal geometric or curved-edge shape; preferably, the detergent sheet can have a square, rectangular, rhomboid, circular, or oval shape, or a combination thereof.

Regardless of the shape that the water-soluble detergent sheet may have, it can include at least one symbol or message on at least one of the surfaces of said sheet, wherein said symbol or message can be printed or stamped.

EXAMPLE

The invention is illustrated in more detail through the following example, which shall not be considered as a limitation to the invention, but only as a demonstration of the effectiveness of the detergent composition in the form of a flexible, water-soluble sheet, according to the invention itself. All percentages are in weight.

Comparative examples A and B, wherein A is a detergent composition in the form of a flexible, water-soluble sheet, according to the present invention; and B is a detergent composition, according to example 9 in document U.S. Pat. No. 7,094,744.

The performance in suppressing dirt on cotton fabrics was measured through a test using a tergotometer. The dirt used was soybean oil (chosen as a typical cooking grease dirt), with an added violet colorant to act as a visual indicator. The clothes used for the test were cotton fabrics measuring 10 cm×10 cm (4 in×4 in), each one swirled with 0.5 ml of soybean oil dyed in violet color; said fabrics were treated in tergotometers using the detergent compositions in the form of a sheet, under the following conditions:

temperature: 25° C. (77° F.);
dosage: 3 grams of product per one liter of washing water;
washing time with stirring: 20 minutes.

Once the test clothes were processed, a comparative analysis of the results was conducted, measuring the reflectance of the samples in a colorimeter, wherein the results are expressed in terms of ΔR, using the formula:

$$\Delta R=(Rw-Ru)$$

where:
R=reflectance
u=stained clothes, not washed
w=stained clothes, washed

Based on the above, ΔR values for each composition are the following:

$$\Delta R(A)=25.7$$

$$\Delta R(B)=16.3$$

As can be observed in the above results, the clothes treated with the detergent composition in the form of a flexible, water-soluble sheet, according to the present invention, show a behavior that is 57.7% higher than the formulation in the state of the art.

Many modifications and other embodiments of the present invention can be deduced by an person skilled in the state of the art and who is informed of the teachings of the present invention. Therefore, it is understood that the invention is not limited to the specific embodiment described, and that the modifications and embodiments are meant to be included within the scope of the enclosed claims.

The invention claimed is:

1. Detergent composition in the form of a flexible, water-soluble sheet, consisting of:
(i) 10-15% (p/p) of a water-soluble polymeric component;
(ii) 30-37% (p/p) of sodium dodecyl sulfate;
(iii) 7-10% (p/p) of primary alcohol ethoxylate;
(iv) 1-4% (p/p) of a mineral oil;
(v) 11-17% (p/p) of glycerin;
(vi) 1-4% (p/p) of coconut diethanolamide;
(vii) 18-25% (p/p) of water; and
(viii) 0.5-2.0% (p/p) of at least one additional supplementary component.

2. The detergent composition in the form of a flexible, water-soluble sheet claim 1, wherein the water-soluble polymeric component is polyvinyl alcohol.

3. The detergent composition in the form of a flexible, water-soluble sheet, according to claim 1, wherein the additional supplementary component is selected from the group consisting of: whiteners, brighteners, colorants, perfumes, and softeners.

4. The detergent composition in the form of a flexible, water-soluble sheet, according to claim 3, wherein the additional, supplementary component is a perfume.

5. The detergent composition in the form of a flexible, water-soluble sheet according to claim 1, consisting of:
(i) 10-15% (p/p) of polyvinyl alcohol;
(ii) 30-37% (p/p) of sodium dodecyl sulfate;
(iii) 7-10% (p/p) of primary alcohol ethoxylate;
(iv) 1-4% (p/p) of a mineral oil;
(v) 11-17% (p/p) of glycerin;
(vi) 1-4% (p/p) of coconut diethanolamide;
(vii) 8-25% (p/p) of water; and
(viii) 0.5-2.0% (p/p) of perfume.

6. Water-soluble detergent sheet, consisting of:
(i) 10-15% (p/p) of polyvinyl alcohol;
(ii) 30-37% (p/p) of sodium dodecyl sulfate;
(iii) 7-10% (p/p) of primary alcohol ethoxylate;
(iv) 1-4% (p/p) of a mineral oil;
(v) 11-17% (p/p) of glycerin;
(vi) 1-4% (p/p) of coconut diethanolamide;
(vii) 18-25% (p/p) of water; and
(viii) 0.5-2.0% (p/p) of perfume.

7. The water-soluble detergent sheet, according to claim 6, having a polygonal or curved-edge geometric shape.

8. The water-soluble detergent sheet, according to claim 7, wherein the geometric shape is a square, rectangle, rhomboid, circle, or oval, or a combination thereof.

9. The water-soluble detergent sheet, according to claim 6, having an irregular shape.

10. The water-soluble detergent sheet, according to claim 6, having the possibility of including at least one symbol or message on at least one of the surfaces of the sheet.

11. The water-soluble detergent sheet, according to claim 10, wherein the symbol or message can be printed or stamped.

* * * * *